US006264534B1

(12) United States Patent
Panyard et al.

(10) Patent No.: US 6,264,534 B1
(45) Date of Patent: Jul. 24, 2001

(54) METHOD AND TOOLING FOR AUTOMATED WET OR DRY SANDING OF A VEHICLE SURFACE

(75) Inventors: James Robert Panyard, Livonia; Scott Louis Radabaugh, Novi; Thomas Eric Pearson, Grosse Lle; Ronald Rene Wiggle, Dearborn, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/276,613

(22) Filed: Mar. 25, 1999

(51) Int. Cl.[7] ..... B24B 49/00

(52) U.S. Cl. ..... 451/11; 451/458; 451/450; 451/24; 451/26; 451/159; 451/160; 451/295

(58) Field of Search ..... 451/11, 24, 26, 451/119, 158, 159, 160, 259, 295, 458, 449, 450

(56) References Cited

U.S. PATENT DOCUMENTS

| | | | | |
|---|---|---|---|---|
| 4,102,084 | * | 7/1978 | Bloomquist | 451/357 |
| 4,115,956 | | 9/1978 | Huffman . | |
| 4,383,393 | | 5/1983 | Takubo . | |
| 4,423,569 | | 1/1984 | Stern et al. . | |
| 4,485,594 | | 12/1984 | Guertin et al. . | |
| 4,587,764 | | 5/1986 | Leone et al. . | |
| 4,773,187 | | 9/1988 | Ohta et al. . | |
| 5,077,941 | * | 1/1992 | Whitney | 451/5 |
| 5,197,229 | | 3/1993 | Kanamaru et al. . | |
| 5,231,803 | * | 8/1993 | Lanzer | 451/5 |
| 5,377,455 | * | 1/1995 | Lanzer | 451/5 |
| 5,394,654 | * | 3/1995 | Shimbara et al. | 451/8 |
| 5,482,496 | * | 1/1996 | Lanzer | 451/5 |

FOREIGN PATENT DOCUMENTS

0847834A1 12/1987 (GB) .

* cited by examiner

*Primary Examiner*—M. Rachuba
(74) *Attorney, Agent, or Firm*—Damian Porcari; William J. Coughlin

(57) ABSTRACT

An automotive vehicle body can be sanded with a robotic sanding (polishing) disk that is carried on a robotic head, such that the sanding disk has a relatively constant unit pressure on the vehicle surface as the head moves the sanding disk along the vehicle surface. An automatic supply mechanism can be employed to periodically remove a worn sanding disk from the head, and replace the worn sanding disk with a new sanding disk.

6 Claims, 3 Drawing Sheets

METHOD AND TOOLING FOR AUTOMATED WET OR DRY SANDING OF A VEHICLE SURFACE

BACKGROUND AND SUMMARY OF THE INVENTION

This invention relates to a mechanism for exerting a pressurized sanding force on a vehicle surface, particularly an electro-coated, primed or freshly painted vehicle surface.

During painting operations on newly manufactured vehicles it is a conventional practice to sand the vehicle surface after the application of a color coat to the surface, and prior to the application of clear coat. The sanding operation is sometimes performed by a human technician while the vehicle is moving along a predetermined path in a paint booth.

On problem with conventional sanding practice is that it is difficult for the human technician to develop a consistent and satisfactory sanding pressure on the vehicle surface. The present invention relates to a robotic sanding mechanism wherein a rotary sanding disk is moved along a predetermined path on the vehicle surface while exerting a controlled pressure on the surface being sanded.

The robotic sanding mechanism comprises a robotic support structure that is lockable to, or tracks, the vehicle while the vehicle is moving along a predetermined path (or is stationary) and a sanding head that can change its angulation in accordance with changes in the vehicle surface contour. The sanding head supports a rotatable sanding disk that can rotate in various different planes, e.g. vertical, horizontal or at various angulations between the horizontal and vertical, in accordance with the changing vehicle contour.

The sanding head comprises a carriage that can move on a line normal to the surface being sanded, and a force responsive means that maintains a relatively constant pressure between the sanding disk and the vehicle surface being sanded. This force-responsive means is operable whatever the orientation of the sanding disk, i.e. horizontal, vertical, or various intermediate angulations.

The sanding head preferably includes means for supplying aerated water and or ambient air to the sanding disk, whereby the sanding disk is prevented from undergoing an undesired vacuum-lock grip relation to the vehicle surface being sanded. The sanding disk can remain in operable frictional contact with the vehicle surface without becoming disconnected from the sanding disk mounting device.

The sanding head may be designed to reduce an undesired vacuum lock action that can occur between the sanding disk and the vehicle surface. Special passages in the head introduce air into the interface between the sanding disk and vehicle surface, to reduce or eliminate the undesired vacuum lock action.

In preferred practice of the invention, an automatic means is provided for removing a worn sanding disk from the sanding head, and replacing the worn disk with a new sanding disk. This feature keeps the robotic sanding mechanism in synchronism with a line of moving vehicles, such that the vehicle conveyour system can remain in continuous operation, even when it is necessary to replace a worn sanding disk.

Specific features of the invention will be apparent from the attached drawings and description of an illustrative embodiment of the invention.

DESCRIPTION OF A PREFERRED EMBODIMENT OF THE INVENTION

Figure 4:
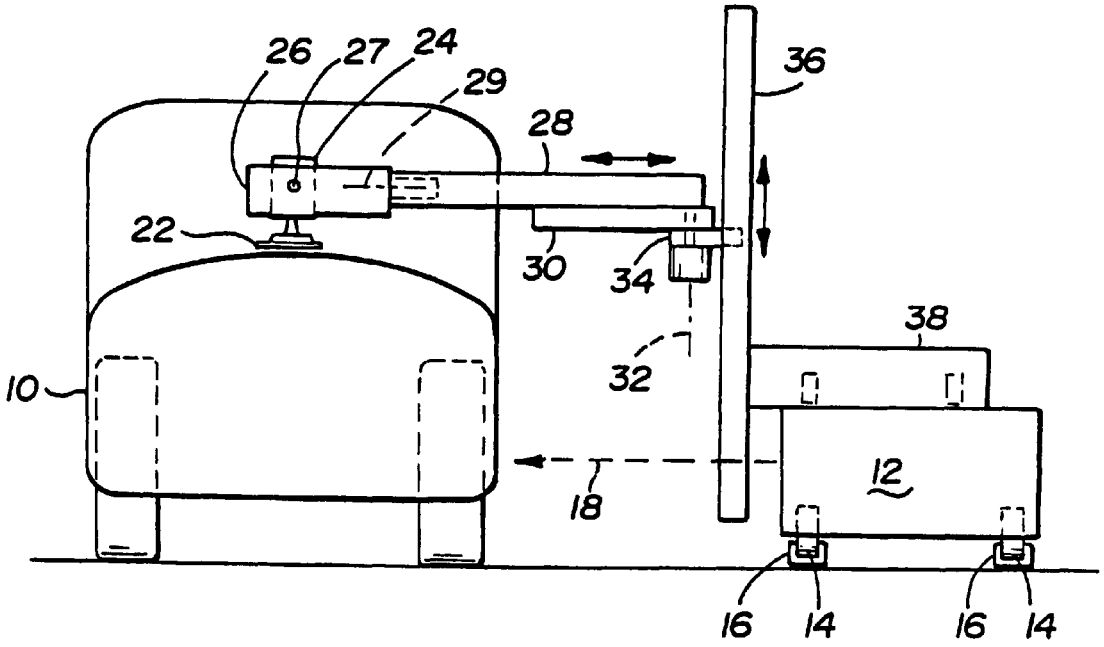
FIG.4 is a schematic illustration of a robotic mechanism for moving the FIG. 1 sanding head along a predetermined path across the surface of a vehicle that is to be sanded.

Referring to FIG. 4, there is shown a robotic control system for a sanding mechanism that is designed to sand a predetermined surface portion of a vehicle 10 while the vehicle is either stationary or moving slowly normal to the plane of the paper. Typically, the vehicle will be moving continuously in a paint booth while the sanding operation is being performed on a portion of the vehicle surface, or the vehicle will be stopped and located prior to sanding. Multiple robotic sanding mechanisms can be used for sanding different portions of the vehicle, one mechanism for the hood, a second mechanism for the roof, a third mechanism for the rear deck, or other configurations, etc.

The robotic control mechanism can take various forms. As illustratively shown in FIG. 4, the robotic system includes a powered base 12 having wheels 14 for allowing the base to move along tracks 16 that parallel the movement of vehicle 10 while the vehicle is being moved slowly along, via a conveyor, not shown. Various guide systems can be used to guide base 12 along a path that parallels the movement direction of the vehicle. Base 12 can house an optical tracking mechanism designed to sight a unique portion of the vehicle, e.g. fender leading edge or be driven to location by a conveyor based encoder. The optical or encoder tracking mechanism can be coupled to a power means in base 12, whereby base 12 can move in synchronism with the vehicle while the sanding operation is being performed on the vehicle. In FIG. 4 the line-of-sight connection between the optical or conveyor encoding tracking mechanism and the vehicle is indicated by numeral 18. Various types of mechanical connections could be used for synchronizing the motion of base 12 with the motion of the vehicle while the vehicle sanding operation is being performed. If the vehicle is stationary, the body will likely be lifted and located and optimally positioned with an optical or other sensor technology.

When the vehicle sanding operation is completed, base 12 will be powered in a reverse direction along tracks 14, back to a starting position for receiving the next vehicle to be sanded and or a lifted and located body will be lowered back onto its conveyor carrier. Usually the reverse motion of base 10 to the starting position will be considerably faster than the forward motion used during the sanding operation. Some of the wheels 14 can be powered wheels having tractive engagement with tracks 16.

The vehicle sanding operation can be accomplished by one or more rotary sanding disks 22 supported on a sanding head 24. The sanding head may be manipulatable on a wrist structure 26 around a horizontal axis 27; the wrist structure is in turn rotatable around a horizontal axis 29 on an arm 28. Arm 28 is slidable horizontally along a support arm 30 that is swingable around a vertical axis 32 extending through a cantilever arm 34 that is slidable vertically on a tower 36. Optionally, any multi-axis robotic system may be employed to position the sanding head. The FIG. 4 robotic control system is representative of various robotic systems that could be used in practice of the invention.

Tower 36 is supported on a carrier 38 that is mounted for horizontal motion (normal to the plane of the paper) on base 12. Servo motors are included in the robotic mechanism for moving the respective components, under computer control. Software embodied in the computer causes sanding disk 22 to traverse a predetermined surface area of vehicle 10 (e.g. the hood and front fender area) while the vehicle is moving slowly along a predetermined path.

The movement of carrier 38 on base 12 is used to effectively relocate sanding disk 22 in a front-to-rear direction, i.e., the first pass of the sanding disk can be made transversely along the frontmost surface of the vehicle, the next pass transversely along a pathline spaced a slight distance behind the first pass, and so on. Movement of arm 28 is used to move the sanding disk 22 in a transverse direction. Vertical movement of arm 34 along tower 36 is used to shift the sanding disk vertically. Rotary motions around axis 27 and axis 29 vary the sanding disk angulation.

The various motions are used by the computer in various combinations to move the sanding disk 22 in a prescribed path along the vehicle surface, whereby the mechanism effectively sands a predetermined surface area of the vehicle without human effort or assistance.

Figure 1:
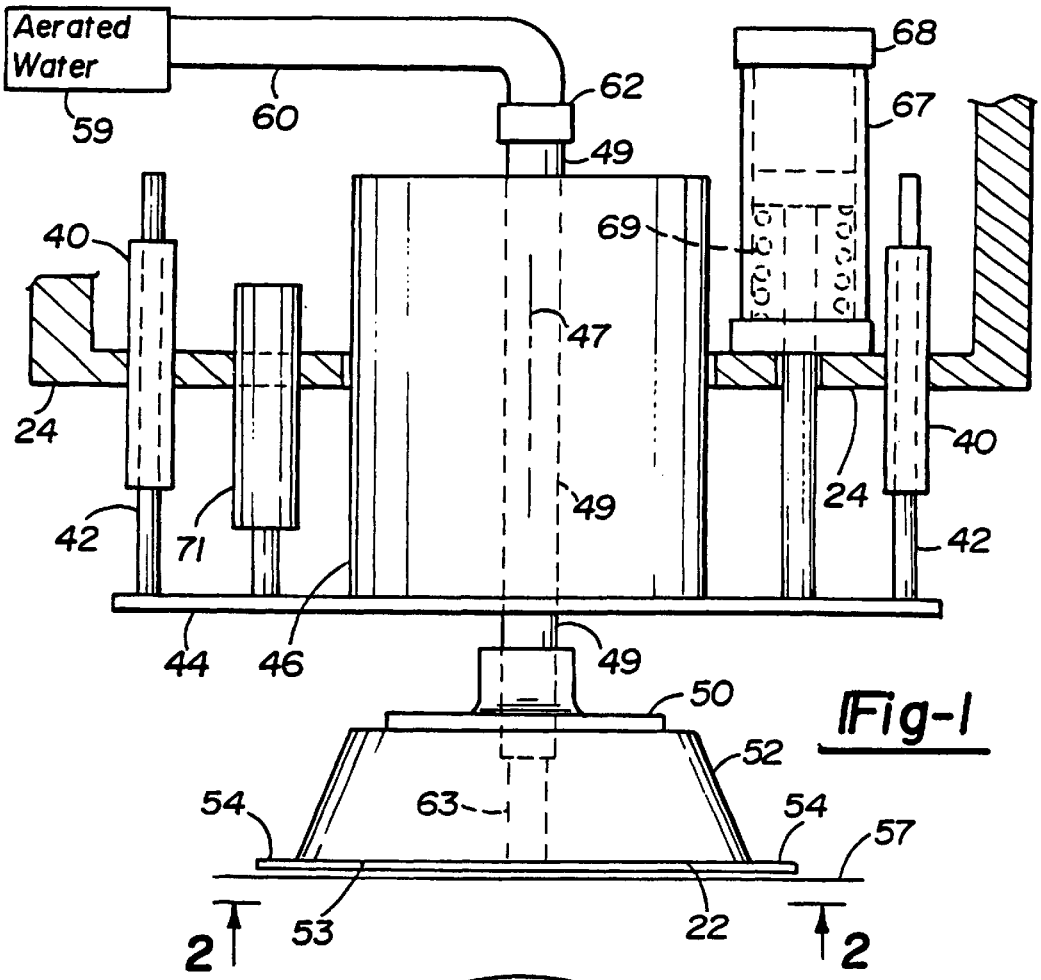
FIG. 1 is a fragmentary sectional view taken through a sanding head of the present invention.

FIG. 1 shows the sanding head 24 used in one form of the invention. The sanding head 24 comprises a housing having two or more guides 40 that slidably engage slide rods 42 carried by a carriage 44. A rotary motor 46 is supported on the carriage so that its rotational axis 47 extends parallel to the direction of carriage motion, dictated by slide rods 42. Thus, motor 46 is capable of bodily movement along axis 47 while the motor drive shaft 49 rotates around axis 47.

Drive shaft 49 has one end thereof attached to a radial plate 50 that carries a circular resilient foam pad 52. The aforementioned sanding disk 22 is releasably attached to the end face 53 of foam pad 52. In preferred practice of the invention, the facing surfaces of pad 52 and sanding disk 22 are comprised of interlockable hook-and-loop fastener materials, e.g. materials available under the trademark VELCRO or other brands. The sanding disk can be attached to a sheer resistant foam pad 52 by moving the disk into contact with end face 53 of the foam pad, and then slightly rotating or pivoting the pad to enhance the interlocking action of the hook-and-loop fastener materials. A worn sanding disk can be removed from foam pad 52 by grasping the protruding edge 54 of the sanding disk and exerting a pulling force thereon, so that the sanding disk peels away from the foam pad.

The sanding operation on vehicle surface 57 (FIG. 1) involves the application of either dry, water, or aerated water to interface between disk 22 and vehicle surface 57. In the illustrated arrangement the aerated water is pumped from source 59 through a fixed or flexible tube 60 and into a hollow tubular drive shaft 49 that extends axially through motor 46. One end of tubular shaft 49 fits into a seal 62 on the end of tube 60; the other end of shaft 49 communicates with a cylindrical passage 63 formed in foam pad 52. Sanding disk 22 has a central hole 64 (FIG. 2) that communicates with passage 63, whereby aerated water is supplied to the interface between disk 22 and the vehicle surface 57.

During the wet sanding operation, the water supplied from source 59 entrains minute grit (paint) particles from the vehicle surface. The grit-water solution is centrifugally thrown off the edge of sanding disk 22 so that a vacuum condition tends to be created between the disk and vehicle surface 57. Such a vacuum condition is undesirable in that the sanding disk tends to become locked to the vehicle surface, and to be disconnected from surface 53 of the foam pad. Such disconnection of the sanding disk from foam pad 52 interferes with the sanding operation, in that the disk can slip relative to the foam pad, or be torn, or be displaced laterally from its centered position on the pad.

Figure 2:
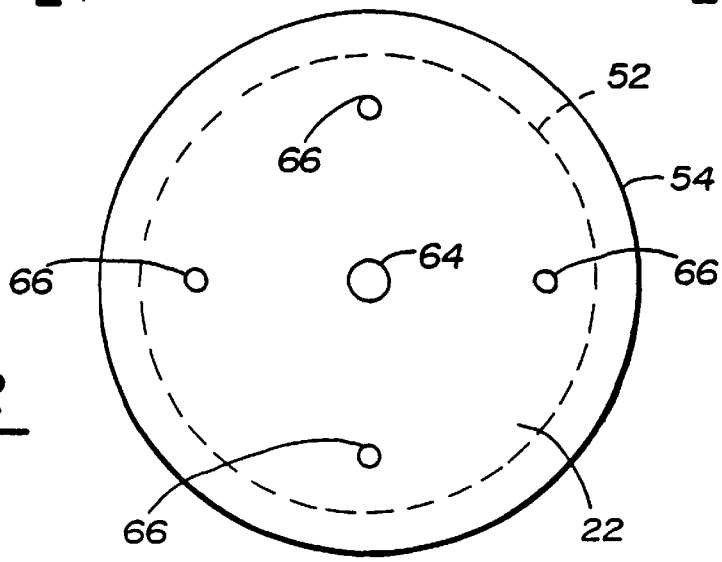
FIG. 2 is a view taken on line 2—2 in FIG. 1.

The use of aerated water f or the grit-removal function partially overcomes the undesired vacuum condition between the sanding disk and foam pad. However, in order to further counteract the vacuum condition, sanding disk 22 is provided with multiple holes 66 located near the disk outer edge, but inboard from the peripheral edge of foam pad 52 (as seen in FIG. 2). Holes 66 act as air passages from the ambient atmosphere to the interface between the sanding disk 22 and vehicle surface 57.

The interlocking fibrous hook-and-loop fastener materials between disk 22 and foam pad surface 53 form miniature air cavities that enable air to flow from the edge of pad 52 to the various holes 66. Should a sub-atmospheric condition develop in the interface between sanding disk 22 and vehicle surface 57, atmospheric air will be drawn through the fibrous fastener materials into holes 66, thereby relieving the vacuum condition. The sanding disk can remain in continuous contact with vehicle surface 57 during a sanding operation. It is not necessary to lift the sanding disk from the vehicle surface for vacuum-relief purposes.

As previously noted, motor 46 is mounted on a carriage 46 that can move in a direction parallel to motor axis 47 (via rods 42 and tubular guides 40). The carriage is normally biased toward vehicle surface 57 by means of an air cylinder 67 suitably mounted on head 24. Pressurized air admitted to end 68 of the cylinder provides the operating force for achieving the desired pressure contact between sanding disk 22 and vehicle surface 57. This constant force could similarly be accomplished using an all electric servo/motor system.

The pressure of the air admitted to cylinder 67 may be controlled by a load cell 71 trained between sanding head 24 and carriage 44. A strain gage within the load cell produces a control signal that can be used by a servo motor for operating a metering valve in the air supply to cylinder 67. The load cell can be used in combination with the servo motor to maintain a relatively constant pressure between sanding disk 22 and the vehicle surface 57. The sanding pressure can be set at a value higher than the pressure achievable by a human being while operating a manual sanding tool. Thus, the use of a robotic sanding mechanism, as described, can shorten the time required for a vehicle sanding operation.

As shown in FIG. 1, the sanding head supports a single rotary sanding disk 22. However, multiple sanding disks can be supported on the sanding head. Each sanding disk is powered by a separate motor mounted on a separate or common floatable carriage, such that each sanding disk can have the same optimal pressure contact on the vehicle surface.

Figure 3:
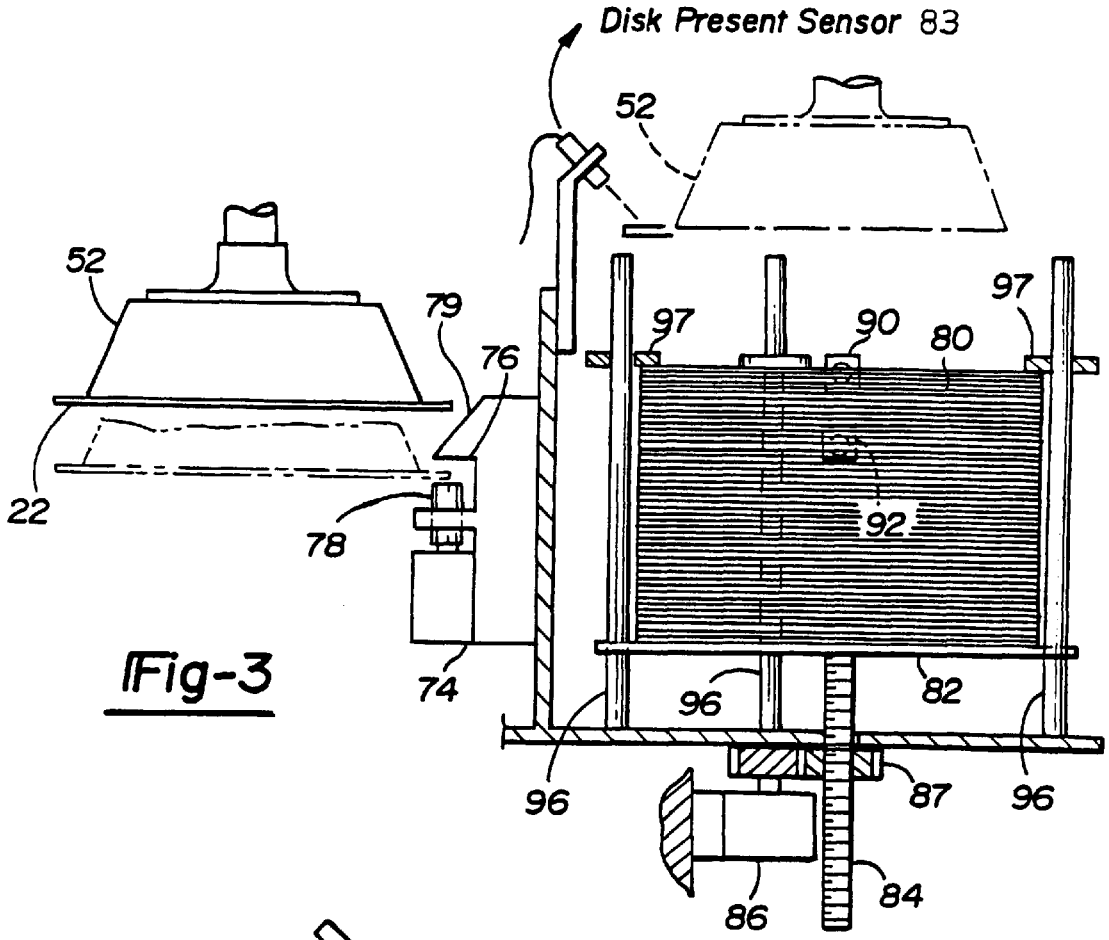
FIG. 3 is a schematic view of a mechanism that can be employed with the FIG. 1 sanding mechanism for replacing a worn sanding disk.

Periodically, it becomes necessary to replace a worn sanding disk on the foam pad 52. FIG. 3 shows one means that can be used for replacing a sanding disk when the disk has a diminished sanding capability (determined arbitrarily as when the disk has been used on a predetermined number of vehicles).

In FIG. 3, the apparatus at the left portion of the Fig. serves to remove a worn sanding disk from pad 52; the apparatus at the right hand portion of the Fig. serves to attach a new sanding disk to the pad.

The FIG. 3 apparatus comprises a disk gripper device 74 that provides a downwardly facing anvil surface 76 and a vertically movable gripper element 78. Gripper element 78 can be operated, up or down, by an air cylinder or solenoid. As shown in FIG. 3, gripper element 78 is in the down position.

When foam pad 52 is moved downwardly from the full line position to the dashed line position (FIG. 3), the protruding edge of the sanding disk is deflected by surface 79 of the disk gripper device and then resiliently returned to the normal condition. With the disk edge located between element 78 and anvil surface 76, the gripper element can be powered up to hold the gripped edge in the gripper device. Foam pad 52 can then be moved upwardly to separate the worn sanding disk from the foam pad 52.

The motions of pad 52 depicted in FIG. 3 can be achieved by the robot apparatus shown in FIG. 4. Initial movement of the foam pad to a position above gripper device 74 can be accomplished by swinging arm 30 around pivot axis 32. Vertical motions of the foam pad can be accomplished by moving arm 34 up or down on tower 36. The motions can be computer-controlled.

FIG. 3 shows an apparatus for attaching a new sanding disk to foam pad 52. A stack of sanding disks is supported on a platform 82 that is attached to a vertical screw 84. Motor 86 is arranged below platform 82 to rotate a nut 87 that is in mesh with screw 84, whereby platform 82 can be elevated to position the uppermost disk in stack 80 at a predetermined elevation. The disks in the stack are positioned with the hook-and-loop fastener surfaces facing upward. Optionally, the stack of disks can be stationary with sensors determining the stack height.

With the stack of sanding disks in a stationary condition, the foam pad 52 can be lowered onto stack 80 and then lifted upwardly to remove the uppermost sanding disk from the stack. While the foam pad is in the lowered position the pad can be rotated a few degrees to enhance the gripper action between the hook-and-loop fastener materials.

Upper and lower seeing eye devices 90 and 92 can be employed to control the position of the sanding disk stack 80. Seeing eye 90 de-energizes motor 86 when the uppermost disk in stack 80 reaches a predetermined elevation. Seeing eye 92 generates an alarm signal when the stack has an insufficient number of sanding disks for continued operation. A new supply of sanding disks then has to be manually loaded onto the stack.

While foam pad 52 is in the process of removing a sanding disk from stack 80 there is a possibility that more than one disk might be removed from the stack, or that the second disk might be displaced laterally from its normal position. To prevent such a circumstance, the apparatus includes plural upstanding guide rods 96 located at the peripheral edges of stack 80. Each rod 96 slidably supports an anular weight (washer) 97. While pad 52 is lifting the uppermost sanding disk from stack 80 the weights 97 cause edge areas of the uppermost disk to bend, such that the bent areas exert downward forces on the stack. The downward force keeps the stack intact by immobilizing the second disk.

The FIG. 3 apparatus includes a sensor 83 for assuring that a sanding disk is affixed to pad 52 before the pad leaves the area above the FIG. 3 apparatus. Sensor 83 comprises an optical sensor trained onto the peripheral edge area of a sanding disk 22 properly affixed to the lower face of pad 52.

As pad 52 is lifted from the stack of sanding disks, sensor 83 optically senses the presence of a sanding disk on the pad lower surface. Should sensor 83 detect the absence of a sanding disk on the pad 52 lower surface, the detector will force the system to return pad 52 to the sanding disk stack to repeat the process of removing a single sanding disk from the stack.

Figure 5:
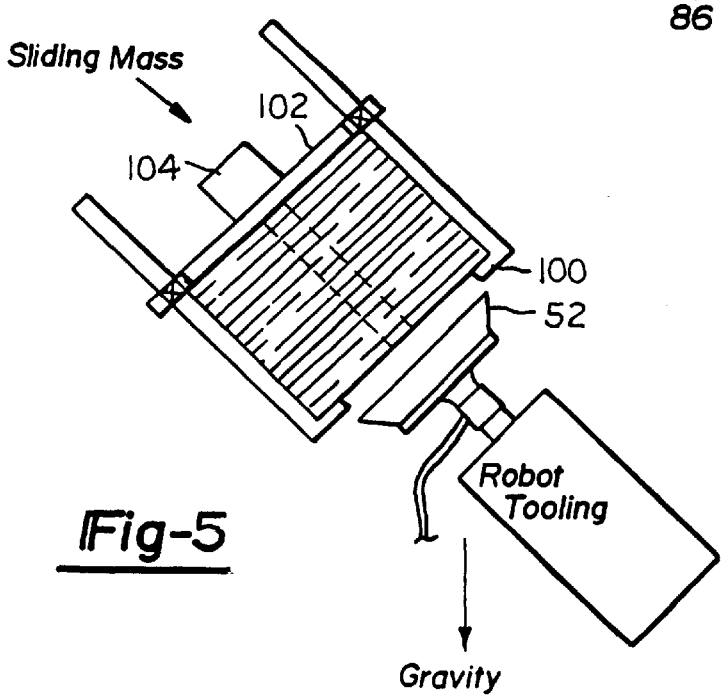
FIG. 5 shows a sanding disk supply chute that can be employed in practice of the invention.

FIG. 5 shows an alternate system for supplying sanding disks to the robotic sanding pad 52. In this case, the sanding disks are loading into a chute 100 from the space above the chute. A pressure plate 102, having a weight 104, is placed on the stack to maintain the sanding disks in close contact with one another in the space above an annular deflectable flap 106.

The robotic sanding head approaches chute 100 from the space below the chute. The head (foam pad) contacts the lowermost sanding disk, and then withdraws downwardly to extract the lowermost disk from the stack. Flap 106 exerts a sufficient retarding force on the lowermost disk to cause the peripheral edge of the disk to flex. The flexing action separates the lowermost sanding disk from the stack.

The FIG. 5 sanding disk supply system is essentially interchangeable with the FIG. 3 sanding disk supply system.

The drawings necessarily show specific features employed in one embodiment of the invention. However, it will be appreciated that some variants can be employed while still practicing the invention.

What is claimed:

1. A vehicle sanding mechanism comprising:

a.) at least one sanding head adapted for movement along a vehicle surface;

b.) a carriage mounted on said head for movement along a line normal to the vehicle surface;

c.) a rotary motor mounted on said carriage; said motor having a hollow drive shaft rotatable around an axis that is parallel to said aforementioned line;

d.) a resilient pad (52) carried by said drive shaft;

e.) a replaceable sanding disk adhesively secured to said pad, whereby said sanding disk rotates with the motor shaft; said sanding disk having an abrasive surface adapted to have three hundred sixty degree pressure contact with a vehicle surface;

f.) force-responsive power means trained between said sanding head and said carriage for maintaining a relatively constant pressure between the sanding disk and the vehicle surface while the motor is operating and the head is moving along the vehicle surface; and g.) means for automatically replacing the sanding disk when said disk has a diminished sanding capability; said disk replacement means comprising a first device for stripping a worn disk from said resilient pad, and a second device for attaching a replacement sanding disk to said paid; said second device comprising means for holding a stack of replacement sanding disks in a predetermined orientation below the disk attachment pad, and weight means overlying edge areas of said stack so that when said disk attachment pad is in the process of lifting a replacement disk from the stack, said weight means exerts sufficient force on the stack to separate the uppermost disk from the stack.

2. The sanding mechanism of claim 1, wherein said resilient pad has a circular flat face adapted to adhesively engage an adhesive surface on an associated sanding disk; each sanding disk having a greater diameter than the diameter of the flat face on said resilient pad, whereby the disk has an annular edge area extending beyond the pad; said first device comprising a disk gripper means that includes an anvil surface aligned with an edge area of worn sanding disk, and a moveable gripper element moveable toward said anvil surface, whereby an edge area of a worn disk can be gripped between said gripper element and said anvil surface.

3. A vehicle sanding mechanism comprising:

a.) at least one sanding head adapted for movement along a vehicle surface;

b.) a carriage mounted on said head for linear movement along a line normal to the vehicle surface during a vehicle sanding operation c.) a rotary motor mounted on said carriage; said motor having a hollow drive shaft rotatable around an axis that is parallel to said aforementioned line;

d.) a resilient pad (52) carried by said drive shaft;

e.) a replaceable sanding disk adhesively secured to said pad, whereby said sanding disk rotates with the motor shaft; said sanding disk having an abrasive surface adapted to have three hundred sixty degree pressure contact with a vehicle surface;

f.) means for feeding water through a hollow drive shaft onto the abrasive surface of the sanding disk;

g.) force-responsive power means trained between said sanding head and said carriage for maintaining a relatively constant pressure between the sanding disk and the vehicle surface while the motor is operating and the head is moving along the vehicle surface; and h.) means for introducing ambient air into the interface between the sanding disk and the vehicle surface, to prevent an undesired vacuum lock action between the disk and vehicle surface; said air-admitting means comprising plural air holes formed in said sanding disk at circumferentially spaced points around the disk.

4. The sanding mechanism of claim 3, wherein said air holes are located relatively close to the disk peripheral edge and relatively remote from the disk rotational axis.

5. The sanding mechanism of claim 4, and further comprising interlocking hook-and-loop adhesive attachment means between said resilient pad and said sanding disk; said hook-and-loop attachment means forming miniature air cavities that enable air to flow from the ambient atmosphere to the air holes in the sanding disk.

6. The sanding mechanism of claim 3 wherein said force-responsive power means comprises a fluid cylinder trained between said head and said carriage, and a pressure-responsive load cell trained between said carriage and said head so that a signal generated by said load cell controls the pressure developed by said fluid cylinder.

* * * * *